US005194682A

United States Patent [19]

Okamura et al.

[11] Patent Number: 5,194,682

[45] Date of Patent: Mar. 16, 1993

[54] MUSICAL ACCOMPANIMENT PLAYING APPARATUS

[75] Inventors: Masahiro Okamura; Masuhiro Sato; Naoto Inaba; Yoshiyuki Akiba; Toshiki Nakai, all of Tokyo, Japan

[73] Assignee: Pioneer Electronic Corporation, Tokyo, Japan

[21] Appl. No.: 797,542

[22] Filed: Nov. 25, 1991

[30] Foreign Application Priority Data

Nov. 29, 1990 [JP] Japan ..... 2-332838

[51] Int. Cl.[5] ..... G10H 1/08; G10H 1/36; G10H 1/46

[52] U.S. Cl. ..... 84/625; 84/626; 84/633; 84/634; 84/645

[58] Field of Search ..... 84/609-620, 84/625-638, 645, 453

[56] References Cited

U.S. PATENT DOCUMENTS 4,771,671 9/1988 Hoff, Jr. ..... 84/645

4,829,872 5/1989 Topic et al. ..... 84/453

*Primary Examiner*—Stanley J. Witkowski

*Attorney, Agent, or Firm*—Kane, Dalsimer, Sullivan, Kurucz, Levy, Eisele and Richard

[57] ABSTRACT

In a musical accompaniment playing apparatus, a reproducing unit reproduces control information from a recording medium on which control information is recorded according to a MIDI standard, a sound source unit generates musical accompaniment information by the control information, a transducer transforms a singer's voice to voice information, a control unit controls a volume level of the musical accompaniment information according to the singer's ability, mixing unit mixes the musical accompaniment information with the voice information, and an output unit outputs the mixed information as sound.

44 Claims, 13 Drawing Sheets

FIG. 5(A)
| NOTE ON ON/OFF | CHANNEL (CATEGORY) | NOTE NO. (MUSICAL INTERVAL) | VELOCITY (SOUND VOLUME) |
|---|---|---|---|
| 9 8 | 0 ~ 15 | 0 ~ 127 | 0 ~ 127 |
FIG. 5(B)
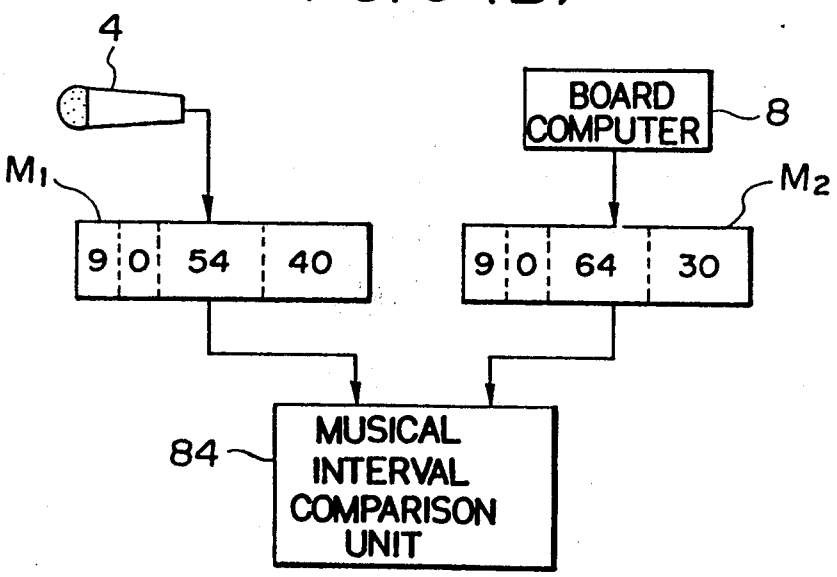
FIG. 5(C)
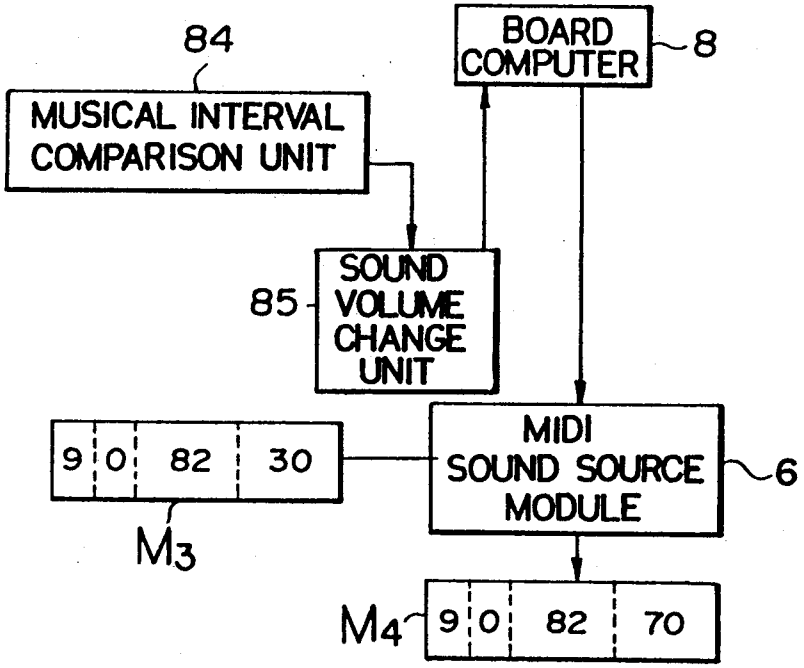

FIG. 12(A)
| BYTE | DATA | |
|---|---|---|
| 1 | Status Byte | $LF_{21}$ |
| 2 ~ 5 | Track Length | $LF_{22}$ |
| 6 | Status Byte | $LF_{23}$ |
| 7 ~ 8 | Lyrics Display Color | $LF_{24}$ |
| 9 | Status Byte | $LF_{25}$ |
| 10 ~ 11 | Lyrics Scroll Color | $LF_{26}$ |
| 11 ~ n | Lyrics Data | $LF_3$ |
| n ~ m | Timing Map | $LF_4$ |
| m+1 ~ m+2 | Track End Data | $LF_5$ |
$LF_2$
FIG. 12(B)
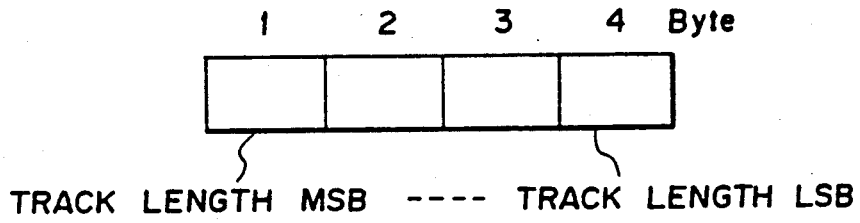
FIG. 12(C)
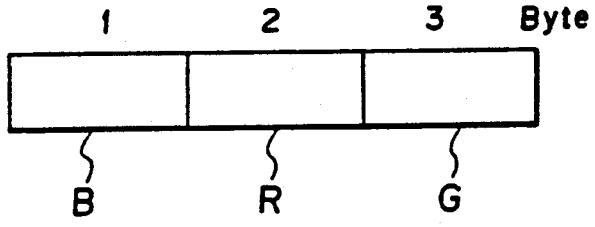

| B | R | G | COLOR |
|---|---|---|---|
| O | O | O | BLACK |
| O | A | A | MUD YELLOW |
| O | A | F | OLIVE COLOR |
| A | O | F | YOUNG GRASS COLOR |
| A | A | A | GRAY |
| A | A | F | BROWNISH GREEN |
| A | F | A | ROSE |
| F | O | F | BLUE |
| F | A | O | VIOLET |
| F | F | O | PURPLE |
| F | F | F | WHITE |

FIG. 15

| MUSICAL COMPOSITION NO. | TITLE OF MUSICAL COMPOSITION | LYRICS WRITER MUSICAL COMPOSER | NAME OF SINGER | LYRICS FOR RETRIEVAL |
|---|---|---|---|---|
| 01 | OOOO | OOOO<br>OOOO | OOOO | OOO OO ···· |
| 02 | ⋮ | ⋮ | ⋮ | ⋮ |
| ⋮ | ⋮ | ⋮ | ⋮ | ⋮ |
| ⋮ | ⋮ | ⋮ | ⋮ | ⋮ |
| n | ⋮ | ⋮ | ⋮ | ⋮ |

FIG. 16

| RESERVATION NO. | NAME OF PERSON WHO MAKES RESERVATION | TITLE OF MUSICAL COMPOSITION |
|---|---|---|
| 01 | OOOO | OOO |
| 02 | OOOO | OOO |
| ⋮ | ⋮ | ⋮ |
| ⋮ | ⋮ | ⋮ |
| n | ⋮ | ⋮ |

MUSICAL ACCOMPANIMENT PLAYING APPARATUS

BACKGROUND OF THE INVENTION

This invention relates to so called a musical accompaniment playing apparatus or "KARAOKE" apparatus, and more particularly to a musical accompaniment playing apparatus using a MIDI (Musical Instrument Digital Interface).

Hitherto, as the musical accompaniment playing apparatus, there are known the playing apparatus in the form of a laser video disk and the playing apparatus in the form of a compact disk.

The apparatus for reproducing musical accompaniment information in the form of a laser video disk (LVD) comprises a LVD automatic changer for accommodating therein a plurality of laser video disks serving as the musical accompaniment information recording medium and reproducing them, a commander for controlling the LVD automatic changer to allow it to select a desired laser video disk in the LVD automatic changer by a request inputted from a control unit, an amplifier and a speaker for outputting a reproduced audio signal as a sound, an image display unit for displaying a reproduced image signal as an image, and a microphone for changing a voice sung to an audio signal to output it to the amplifier. The amplifier mixes the audio signal from the LVD automatic changer and the audio signal of the voice sung from the microphone to output a mixed signal to the speaker.

On the other hand, the apparatus for reproducing musical accompaniment information in the form of a compact disk (CD) comprises a CD automatic changer for accommodating therein a plurality of CDs and reproducing them, a commander for controlling the CD automatic changer to allow it to select a desired CD in the CD automatic changer by a request inputted from a control unit, an amplifier and a speaker for outputting a reproduced audio signal as a sound, a graphic decoder for converting graphic data reproduced from subcode data in the CD to an image signal, a graphic display unit for displaying the image signal as an image, and a microphone for changing a voice sung to an audio signal to output it to the amplifier. The amplifier mixes the audio signal from the CD automatic changer and the audio signal of the voice sung from the microphone to output a mixed signal to the speaker.

By constituting the musical accompaniment playing apparatus in this way, a singer can sing a song with a musical accompaniment, and can enjoy, at the same time, a corresponding image.

In musical accompaniment playing apparatus in these forms, in the case where the musical interval of a voice of a singer from the microphone deviates from the musical interval of a musical signal from the musical accompaniment player, an approach was employed to apply echo to a voice signal from the microphone to output it, or to allow the musical interval (key) of the entirety of a music to follow in correspondence with the musical interval of a voice from the microphone.

However, in the case of a method of applying echo, this method merely allows a voice to be easy to be heard, but has no effect to correct deviation of the musical interval. Further, there was the problem that when the musical interval of the entirety of a music is varied in correspondence with the musical interval (key) of a voice of a singer, the key of the music frequently changes, so the singer becomes rather difficult to sing a song, and a listener is disagreeable to hear that song in appreciation thereof.

SUMMARY OF THE INVENTION

An object of the present invention is to provide a musical accompaniment playing apparatus in which even if there takes place any change in the musical interval of a singer, the singer is easy to sing a song and the listener is agreeable to hear that song.

According to one preferred aspect of the present invention, there is provided a musical accompaniment playing apparatus comprising:

a musical accompaniment playing information reproducing unit for reproducing MIDI sound source control information from a musical accompaniment playing information memory medium on which the MIDI sound source control information for controlling MIDI sound source unit generating musical accompaniment playing information in conformity with a MIDI standard is stored;

the MIDI sound source unit for generating the musical accompaniment playing information by the MIDI sound source control information reproduced by the musical accompaniment playing information reproducing unit;

an acoustoelectric transducer for transforming a voice sung by a singer to an electric signal to output it as voice information;

a sound volume control unit for effecting a control so as to increase or decrease the sound volume level of the musical accompaniment playing information in dependency upon a singing ability of the singer;

a mixing unit for mixing the musical accompaniment playing information and the voice information to output it as mixed sound information; and a sound output unit for transforming the mixed sound information to sound to output it.

In the above-mentioned musical accompaniment playing apparatus, the singing ability may include an ability to keep a musical key of a voice sung by the singer in tune with a musical accompaniment outputted by the sound output means or an ability to keep a singing timing of a voice sung by the singer in time with a musical accompaniment outputted by the sound output means.

According to another preferred aspect of the present invention, there is provided a musical accompaniment playing apparatus comprising:

a musical accompaniment information reproducing unit for reproducing MIDI sound source control information from a musical accompaniment information recording medium on which the MIDI sound source control information for controlling MIDI sound source unit to generate musical accompaniment information in conformity with a MIDI standard is recorded;

the MIDI sound source unit for generating the musical accompaniment information by the MIDI sound source control information reproduced by the musical accompaniment information reproducing unit;

an acoustoelectric transducer for transforming a voice sung by a singer to an electric signal to output it as voice information;

a sound volume control unit for controlling a sound volume level of the voice information in dependency upon a singing ability of the singer;

a mixing unit for mixing the musical accompaniment information and the voice information to output it as mixed sound information; and sound output unit for transforming the mixed sound information to sound to output it.

In the above-mentioned musical accompaniment playing apparatus, the said singing ability may include an ability to keep a musical key of a voice sung by the singer in tune with a musical accompaniment outputted by the sound output means or an ability to keep a singing timing of a voice sung by the singer in time with a musical accompaniment outputted by the sound output unit.

According to still another preferred aspect of the present invention, there is provided a musical accompaniment apparatus comprising:

a musical accompaniment information reproducing unit for reproducing MIDI sound source control information and second musical information from a musical accompaniment information recording medium on which the MIDI sound source control information for controlling MIDI sound source unit to generate first musical information in conformity with a MIDI standard and the second musical information to be mixed with the first musical information to form musical accompaniment information are recorded;

the MIDI sound source unit for generating the first musical information by MIDI sound source control information reproduced by the musical accompaniment information reproducing unit;

an acoustoelectric transducer for transforming a voice sung by a singer to an electric signal to output it as voice information;

a sound volume control unit for controlling a sound volume level of the musical accompaniment information in dependency upon a singing ability of the singer;

a mixing unit for mixing the generated first musical information, the reproduced second musical information and the voice information to output it as mixed sound information; and a sound output unit for transforming the mixed sound information to sound to output it.

In the above-mentioned musical accompaniment playing apparatus, the singing ability may include an ability to keep a musical key of a voice sung by the singer in tune with a musical accompaniment outputted by the sound output means or an ability to keep a singing timing of a voice sung by the singer in time with a musical accompaniment outputted by the sound output unit.

According to still another preferred aspect of the present invention, there is provided a musical accompaniment apparatus comprising:

a musical accompaniment information reproducing unit for reproducing MIDI sound source control information and second musical information from a musical accompaniment information recording medium on which the MIDI sound source control information for controlling MIDI sound source unit to generate first musical information in conformity with a MIDI standard and the second musical information to be mixed with the first musical information to form musical accompaniment information are recorded;

the MIDI sound source unit for generating the first musical information by MIDI sound source control information reproduced by the musical accompaniment information reproducing unit;

an acoustoelectric transducer for transforming a voice sung by a singer to an electric signal to output it as voice information;

a sound volume control unit for controlling a sound volume level of the voice information in dependency upon a singing ability of the singer;

a mixing unit for mixing the generated first musical information, the reproduced second musical information and the voice information to output it as mixed sound information; and a sound output unit for transforming the mixed sound information to sound to output it.

In the above-mentioned musical accompaniment playing apparatus, the singing ability may include an ability to keep a musical key of a voice sung by the singer in tune with a musical accompaniment outputted by the sound output means or an ability to keep a singing timing of a voice sung by the singer in time with a musical accompaniment outputted by the sound output unit.

According to still another preferred aspect of the present invention, there is provided a musical accompaniment playing apparatus comprising:

a musical accompaniment information reproducing unit for reproducing MIDI sound source control information from a musical accompaniment information recording medium on which the MIDI sound source control information for controlling MIDI sound source unit to generate musical accompaniment information in conformity with a MIDI standard is recorded, said musical accompaniment information having a plurality of first note information, and the MIDI sound source control information having first MIDI note information for tuning a musical interval of each first note information;

the MIDI sound source unit for generating the musical accompaniment information by the MIDI sound source control information reproduced by the musical accompaniment information reproducing unit;

an acoustoelectric transducer for transforming a voice sung by a singer to an electric signal to output it as voice information, the voice information having a plurality of second note information;

a musical interval detection unit for detecting a musical interval of the second note information to transform said detected musical interval to information according to the MIDI standard to output it as second MIDI note information;

a comparison unit for comparing the first MIDI note information with the second MIDI note information and outputting a result signal, the result signal having a result value according to a difference between the first MIDI note information and the second MIDI note information;

a control unit for controlling a sound volume level of the musical accompaniment information in dependency upon the result value of the outputted result signal;

a mixing unit for mixing the musical accompaniment information and the voice information to output it as mixed sound information; and a sound output unit for transforming the mixed sound information to sound to output it.

According to still another preferred aspect of the present invention, there is provide a musical accompaniment playing apparatus comprising:

a musical accompaniment information reproducing unit for reproducing MIDI sound source control information from a musical accompaniment information recording medium on which the MIDI sound source control information for controlling MIDI sound source unit to generate musical accompaniment information in conformity with a MIDI standard is recorded, said musical accompaniment information having a plurality of first note information, and the MIDI sound source control information having first MIDI note information for tuning a musical interval of each first note information;

the MIDI sound source unit for generating the musical accompaniment information by the MIDI sound source control information reproduced by said musical accompaniment information reproducing unit;

an acoustoelectric transducer for transforming a voice sung by a singer to an electric signal to output it as voice information, the voice information having a plurality of second note information;

a musical interval detection unit for detecting a musical interval of the second note information to transform said detected musical interval to information according to the MIDI standard to output it as second MIDI note information;

a comparison unit for comparing the first MIDI note information with the second MIDI note information and outputting a result signal, the result signal having a result value according to a difference between the first MIDI note information and the second MIDI note information;

a control unit for controlling a sound volume level of the voice information in dependency upon the result value of the outputted result signal;

a mixing unit for mixing the musical accompaniment information and the voice information to output it as mixed sound information; and a sound output unit for transforming the mixed sound information to sound to output it.

BRIEF DESCRIPTION OF THE DRAWINGS

FIG. 15 is a view showing a display example of the Table, and FIG. 16 is a view showing an example of a display of the reservation state of a music.

DETAILED DESCRIPTION OF THE PREFERRED EMBODIMENTS

Prior to the description of preferred embodiments of the present invention, the problems with conventional apparatuses for reproducing musical accompaniment information will be first described with reference to the attached drawings.

Figure 6:
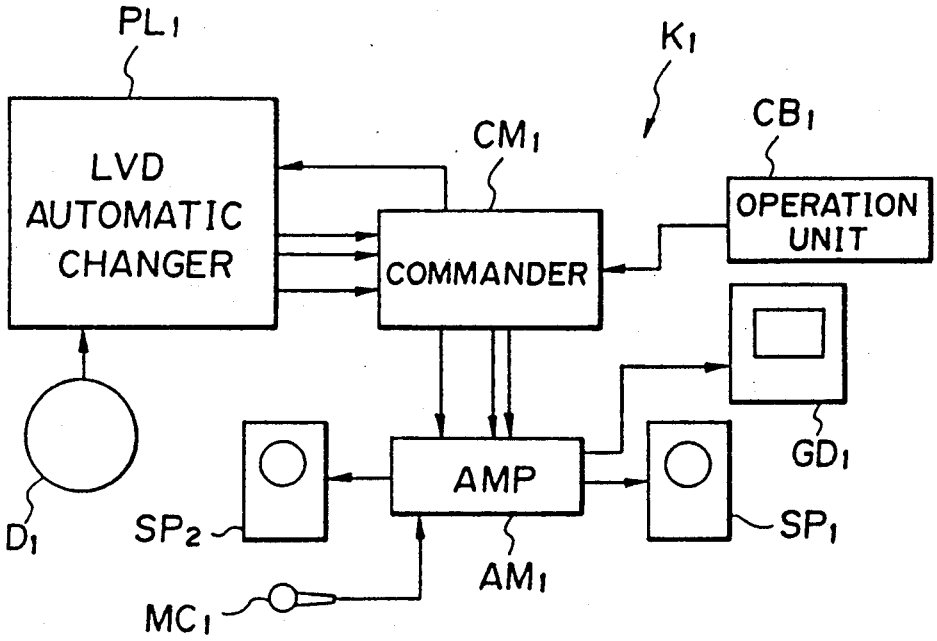

FIG. 6 is a block diagram showing the configuration of an apparatus called a LVD musical accompaniment playing apparatus. This LVD musical accompaniment playing apparatus K1 comprises a LVD automatic changer PL1 for accommodating therein a plurality of laser video disks D1 serving as a musical accompaniment playing information memory medium and reproducing them, a commander CM1 for controlling the LVD automatic changer PL1 to allow it to select a desired laser video disk D1 in the LVD automatic changer PL1 by a request inputted from a operation unit CB1, an amplifier AM1 and speakers SP1 and SP2 for outputting as sound a reproduced audio signal, an image display unit GD1 for displaying a reproduced image signal as an image, and a microphone MC1 for changing a voice sung to an audio signal to output it to the amplifier AM1. The amplifier AM1 mixes an audio signal from the LVD automatic changer PL1 which is a musical signal from the so called musical accompaniment player and an audio signal of a voice sung from the microphone MC1 to output it to the speakers SP1 and SP2. It is to be noted that the commander CM1 may ordinarily include the operation unit CB1.

Figure 7:
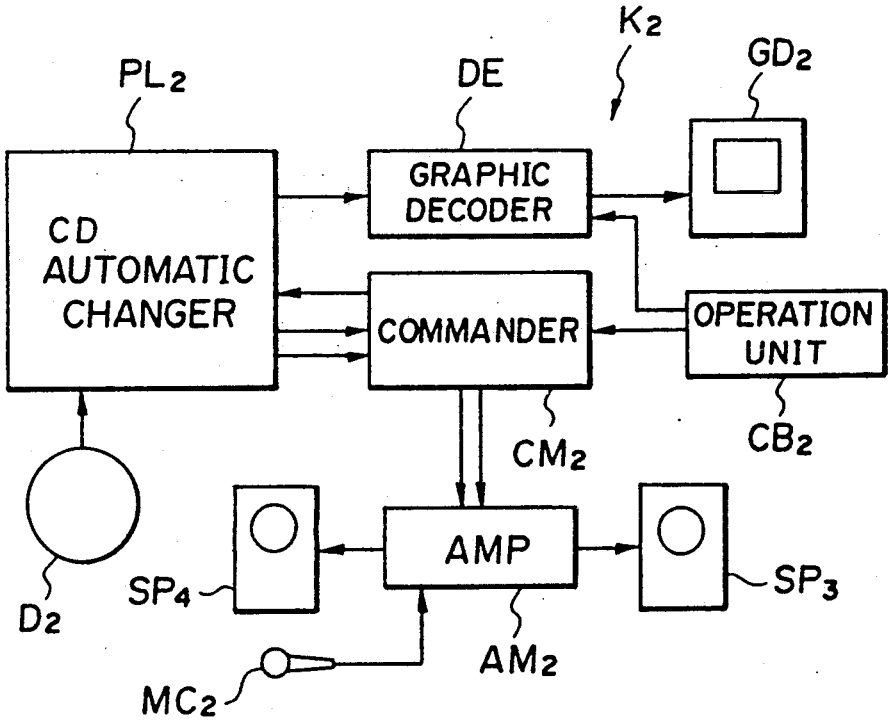

Further, FIG. 7 is a block diagram showing the configuration of an apparatus called a CD musical accompaniment playing apparatus K2. This musical accompaniment playing apparatus K2 comprises a CD automatic changer PL2 for accommodating therein a plurality of compact disks D2 serving as a musical accompaniment playing information memory medium and reproducing them, a commander CM2 for controlling the CD automatic changer PL2 to allow it to select a desired compact disk D2 in the CD automatic changer PL2 by a request inputted from the operation unit CB2, an amplifier AM2 and speakers SP3 and SP4 for outputting a reproduced audio signal as sound, a graphic decoder DE for converting graphic data reproduced from the subcode data in the compact disk D2 to an image signal, an image display unit GD2 for displaying this image signal as an image, and a microphone MC2 for changing a voice sung to an audio signal to output it to the amplifier AM2. The amplifier AM2 mixes an audio signal from the CD automatic changer PL2 which is a musical signal from the so called musical accompaniment player and an audio signal of a voice sung from the microphone MC2 to output it to the speakers SP3 and SP4. It is to be noted that the commander CM2 may ordinarily include the operation unit CB2 and the graphic decoder DE.

By constituting the musical accompaniment playing apparatus in this way, a singer can sing a song with a music from a musical accompaniment player as a musical accompaniment, and can enjoy, at the same time, a corresponding image.

In musical accompaniment playing apparatus in these forms, in the case where the musical interval of a voice of a singer from the microphone deviates from the musical interval of a musical signal from the musical accompaniment player, an approach was employed to apply echo to a voice signal from the microphone to output it, or to allow the musical interval (key) of the entirety of a music to follow in correspondence with the musical interval of a voice from the microphone.

However, in the case of a method of applying echo, this method merely allows a voice to be easy to be heard, but has no effect to correct deviation of the musical interval. Further, there was the problem that when the musical interval of the entirety of a music is varied in correspondence with the musical interval (key) of a voice of a singer, the key of the music frquently changes, so the singer becomes rather difficult to sing a song, and a listener is disagreeable to hear that song in appreciation thereof.

PRINCIPLE OF THE INVENTION

Figure 1:
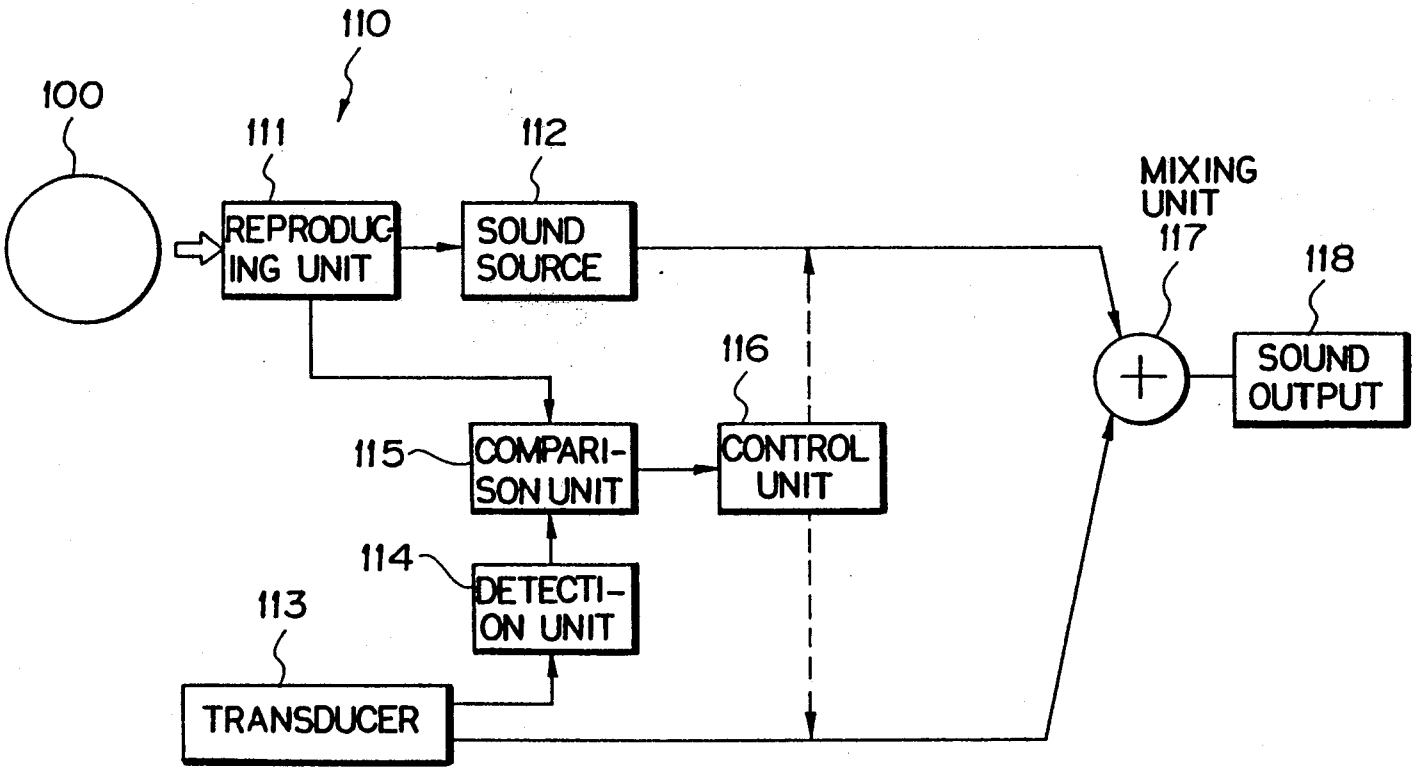
FIG. 1 is a view for explaining the principle of the present invention.

In FIG. 1, a musical accompaniment playing apparatus 110 comprises a musical accompaniment information reproducing unit 111 for reproducing MIDI sound source control information from a musical accompaniment information recording medium 100 on which the MIDI sound source control information for controlling MIDI sound source unit 112 to generate musical accompaniment information in conformity with a MIDI standard is recorded, the musical accompaniment information having a plurality of first note information, and the MIDI sound source control information having first MIDI note information for tuning a musical interval of each first note information; the MIDI sound source unit 112 for generating the musical accompaniment information by the MIDI sound source control information reproduced by the musical accompaniment information reproducing unit 111; an acoustoelectric transducer 113 for transforming a voice sung by a singer to an electric signal to output it as voice information, the voice information having a plurality of second note information; a musical interval detection unit 114 for detecting a musical interval of the second note information to transform the detected musical interval to information according to the MIDI standard to output it as second MIDI note information; a comparison unit 115 for comparing the first MIDI note information with the second MIDI note information and outputting a result signal, the result signal having a result value according to a difference between the first MIDI note information and the second MIDI note information; a control unit 116 for controlling a sound volume level of the musical accompaniment information or a sound volume level of the voice information in dependency upon the result value of the outputted result signal; a mixing unit 117 for mixing the musical accompaniment information and the voice information to output it as mixed sound information; and a sound output unit 118 for transforming the mixed sound information to sound to output it.

In the above-mentioned musical accompaniment playing apparatus, a musical interval detection unit 114, a comparison unit 115 and a control unit 116 are equivalent to a sound volume control unit.

In accordance with this invention thus constructed, in the case where the musical interval of a voice and a singing timing of a singer deviate from the musical interval of the musical accompaniment playing information or the first musical accompaniment information by a fixed value and a fixed time interval, a control is carried out such that the sound volume level of the musical accompaniment becomes large or the sound volume level of the voice becomes small. Thus, a singer becomes easy to sing a song, and a listener also becomes agreeable to hear that song.

EMBODIMENT

Prior to the description of an embodiment of the present invention, the MIDI standard, the MIDI sound source, and the musical accompaniment playing information memory medium based on MIDI used in the present invention will be first described with reference to FIGS. 8 to 16.

(1) MIDI standard and MIDI sound source

The MIDI (Musical Instrument Digital Interface) is the standard determined for permitting musical instruments such as synthesizer or electronic piano, etc. to be connected to each other to effect exchange of information therebetween.

Electronic instruments provided with a hardware based on the MIDI standard and having a function to carry out transmission and reception of a MIDI control signal serving as a musical instrument playing control signal in the form defined to support musical information are called MIDI equipments.

On disks such as CDs (Compact Disk), CD V (Video) or LVD (Laser Video Disk) including CD format digital sound, etc., or tapes such as DAT, etc., subcodes are recorded. There are subcode of P, Q, R, S, T, U, V and W channels. The P and Q channels thereof are used for the purpose of effecting control of a disk player and display.

On the other hand, R to W channels are empty channels called user's bit. Various studies of application to graphic, sound or image, etc. are being conducted. The standard with respect to the graphic format has been already proposed.

Further, MIDI format signals may be recorded in the user's bit area. The standard therefor has been already proposed.

In this case, an approach may be employed to deliver an audio video signal reproduced by the disk player to the AV system to carry out audio visual operation of a program recorded on the disk, and an approach may be also employed to allow the AV system itself to have such a function, or to deliver playing program information to other MIDI equipments. Accordingly, various studies of application to construction of the AV system with realism or presence including electronic musical instruments, or preparation of educational software, etc. are being conducted.

The MIDI equipments play music in accordance with the musical instrument performance program formed by a MIDI signal obtained by converting MIDI format signals sequentially delivered from the disk player to serial signals.

The MIDI control signal delivered to the MIDI equipment is serial data of a transfer rate 31.25 [Kbaud], and 10 bits in total of 8 data bits, and one start bit and one stop bit of respective one bits constitute data corresponding to one unit.

Further, at least one status byte for designating the kind of data sent and the MIDI channel and one or two data bytes introduced by that status are combined to form a message serving as musical information. Accordingly, one message is comprised of 1 to 3 bytes, and a transfer time of 320 to 960 [$\mu$ sec] is required for the transfer. A musical instrument playing program is formed by a series of messages.

Figure 8:
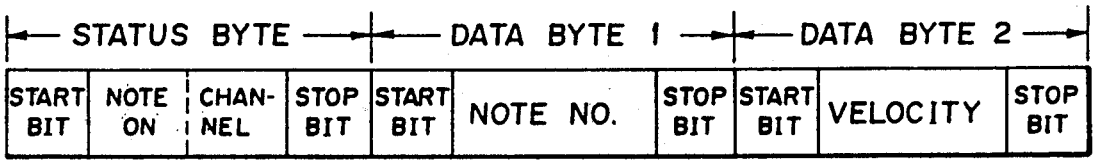
FIGS. 8, 9 and 10 are views for explaining the MIDI standard and the MIDI sound source.

The configuration of a "note on message" which is one example of such a channel voice messages is shown in FIG. 8 as an example of such a message.

Figure 9:
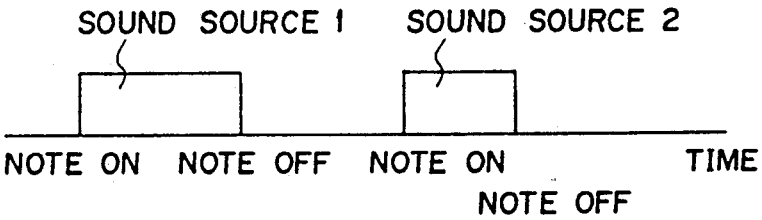

The note on message of the status byte is a command corresponding to the operation that the key of the keyboard is depressed, and is used as a pair with a "note off message" corresponding to the operation that the key of the keyboard is released. Such a relationship is shown in FIG. 9. For the note on message, 9h (h: hexadecimal digit), etc. is used. Further, for the note off message, 8h, etc. is used. The channel can cope with 16 kinds of sound sources, and 0h to Fh are used therefor. The note number of the data byte 1 designates any one of 128 stages (0h to 7Fh) assigneed to the key with the C of the center being as a center. The velocity of the data byte 2 is generally utilized for providing a difference of sound intensity, and designates any one of 128 stages (0h to 7Fh). Responding to the note on message, the MIDI equipment generates a sound of a designated musical scale at a designated intensity. Further, responding to the note off message, the MIDI equipment carries out, e.g., the operation for allowing the key of the keyboard to be released.

Figure 10:
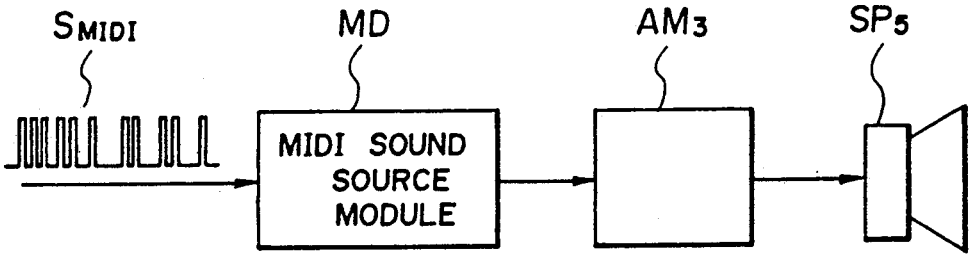

Accordingly, in place of the electronic musical instrument, as shown in FIG. 10, the MIDI sound source module MD, the amplifier AM3 and the speaker SP5 are used, thereby making it possible to generate an arbitrary musical sound by the MIDI control signal $S_{MIDI}$.

(2) Musical accompaniment playing information memory medium based on MIDI

A musical accompaniment playing information recording medium based on MIDI will now be described with reference to FIGS. 11 to 16.

Figure 11:
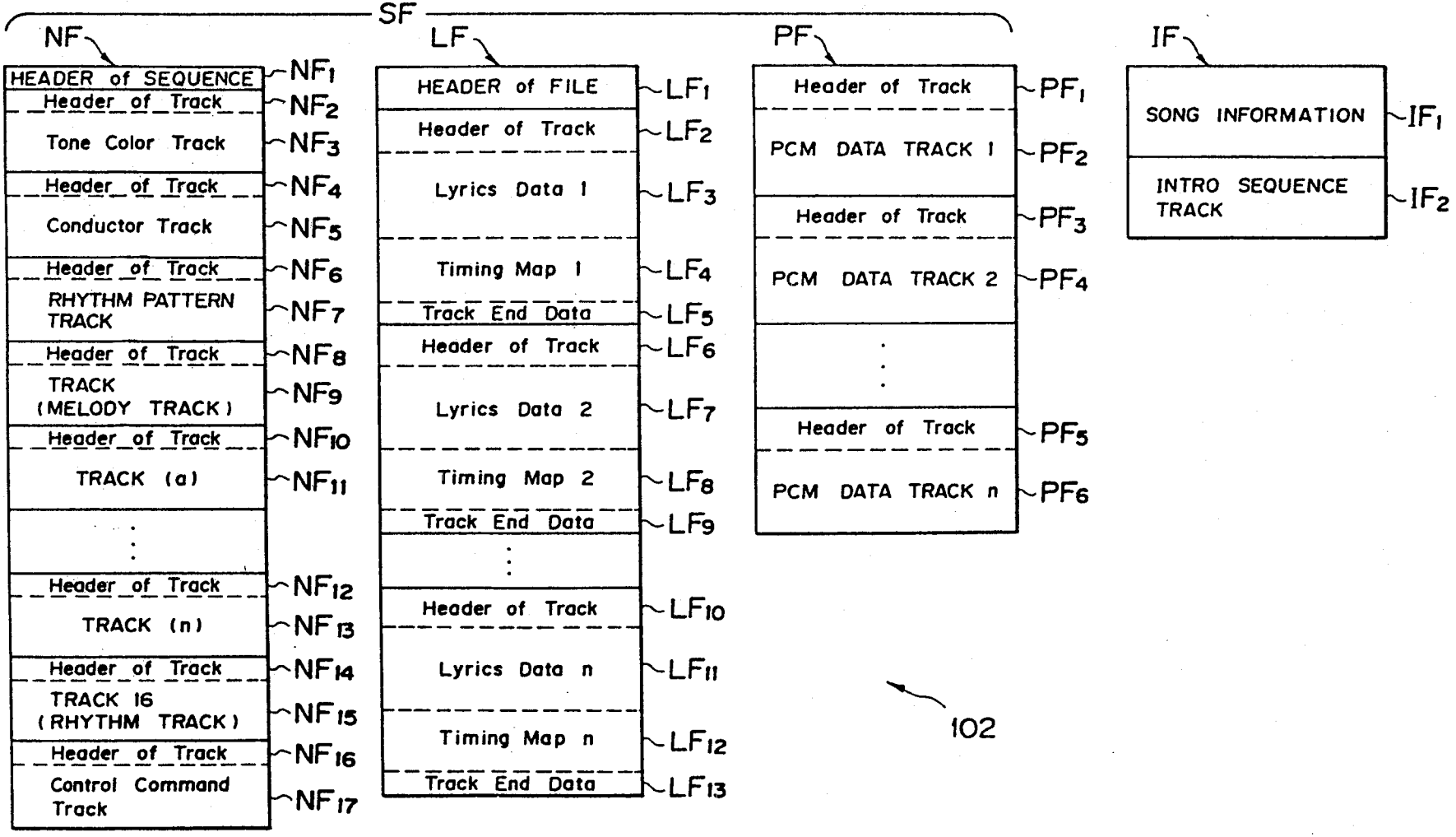
FIG. 11 is a view showing the configuration of the MIDI musical accompaniment playing file which is a first embodiment of the present invention, FIGS. 12(*a*)–12(*c*) are views showing the detailed configuration of the lyrics file in FIG. 3.

FIG. 11 shows the data structure of the MIDI accompaniment music playing file stored in an OMD (Optical Memory Disk). The OMD is a writable optical disk used as a memory.

This MIDI accompaniment music playing file format 102 is roughly classified into a sequence file SF and a Table file IF. The sequence file SF is a file required at the time of playing a musical accompaniment, and includes a note file NF serving as a MIDI sound source control information memory area, a lyrics file LF serving as a lyrics information memory area, and a PCM file PF serving as a second musical accompaniment information memory area. The Table file IF corresponds to a retrieval information memory area. Further, the lyrics file LF, the PCM file PF and the Table file IF constitute a musical accompaniment related information memory area.

The note file NF is a file in which actual playing data is stored, and includes data areas of NF1 to NF17. Among them, the tone color track NF3 stores data for setting a plurality of tone colors of the MIDI sound source. The conductor track NF5 stores data for setting the rhythm and the tempo. The tempo change, etc. is stored into this data area. The rhythm pattern track NF7 stores pattern data corresponding to one measure of the rhythm in relation to rhythm. NF8 to NF15 are called a note track. For this purpose, 16 tracks can be used at the maximum. Data for the MIDI sound source playing are stored therein. The track NF9 is a track exclusive for melody. The track 16 NF15 is a track exclusive for rhythm. The track numbers a to n are 2 to 15. In addition, the control command track NF17 stores various control commands such as illumination control or LD player control, etc..

The lyrics file LF is a file for storing data lyrics Telop displayed on a monitor television, and includes data area of LF1 to LF13. Among them, data of the lyrics themselves are stored into the LF3, LF7 and LF11. Further, data relating to the display timing of the lyrics and the color change speed (scroll) are stored into LF4, LF8 and LF12.

The further detailed structure of the lyrics file LF is shown in FIG. 12(A). FIG. 12(A) shows the example of LF2 to LF5.

The track header section LF2 is a data area for storing data for designating a track length, an initial value of the lyrics Telop display color, and an initial value of the lyrics Telop scroll color, and includes data LF21 to LF26. It is to be noted that data of the lyrics Telop display color and the lyrics Telop scroll color may be omitted. In this case, data are set to a predetermined initial value (default value) by the control unit.

The status LF21 of the track length is one byte (FFh, h:hexadecimal digit), and the track length data LF22 is four bytes as shown in FIG. 12(B). The data of LF22 is stored from the high order byte (MSB) of the track length from the first byte.

The status LF23 of the lyrics display color is one byte (AOh), and the lyrics display color data LF24 is three bytes as shown in FIG. 12(C). The display color of the lyrics Telop is designated by B(blue), R(red) and G(green). The first, second and third byte of the data bytes correspond to B(blue), R(red) and G(green), respectively, and are designated in the range of OOh to OFh.

The status LF25 of the scroll color is one byte (BOh), and the scroll color data LF26 is three bytes. The specification of the data byte is the same as in the case of the lyrics display.

Figures 13, 14:
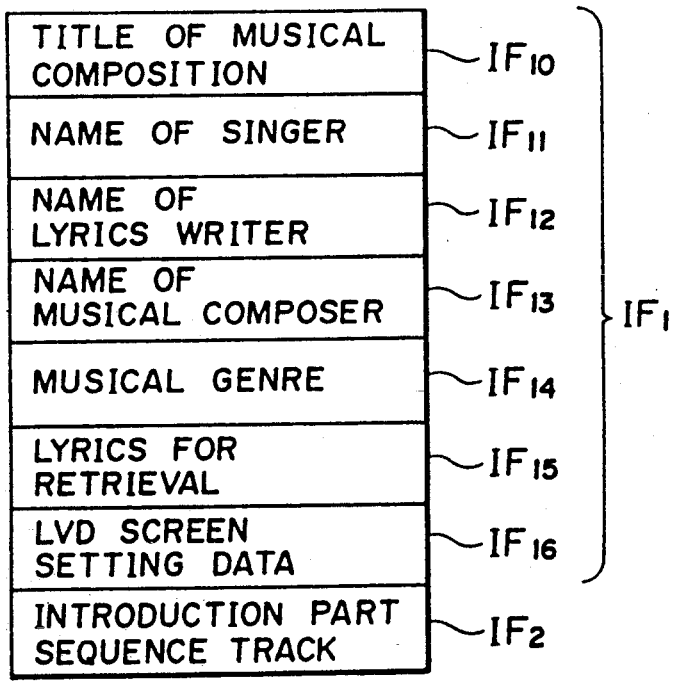
FIG. 13 is a view showing an example of the color code by the lyrics file.
FIG. 14 is a view showing the configuration of the Table file.

An example of the color code by B, R and G is shown in FIG. 13. The lyrics data is stored in the form of the JIS (Japan Industrial Standard) code.

The status of the lyrics data LF3 is COh and the lyrics data succeeding to the status COh is displayed as the lyrics data by one frame. Further, lyrics train numbers are assigned to the lyrics data train succeeding to the status COh in order from 1. In addition, the status and the data of the data end are EOh.

In the data of the timing map LF4, there are included the lyrics Telop display timing, the lyrics Telop erase timing, the lyrics display color, the scroll map data, and the map end.

The status of the lyrics Telop display timing is DFh, and the data is three bytes of [Display Timing] and [Lyrics Number].

At the timing of [Display Timing], the lyrics of the [Lyrics Number] are displayed. With respect to the display timing, the first byte and the second byte of data are stored into the area of the high order byte of timing and the area of the low order byte of timing in order recited.

The status 2 of the lyrics erase timing is DOh, and the data is two bytes of [Off Timing]. The first and second bytes of data correspond to the high order byte of timing and the low order byte of timing, respectively.

The status of the lyrics display color is AOh, and data is three bytes of [Display Color]. The data format is the same as the format of the lyrics display color in the track header. It is to be noted that the lyric display color timing must be subsequent to the display timing of the lyrics Telop display timing.

The status of the scroll color is BOh, and data is three bytes of [Scroll Color]. The data format is the same as the format of the scroll color in the track header. In the timing map, the scroll color timing must be preceding to the scroll map data.

The status of the scroll map data is COh, and data is two bytes of [Scroll Speed] and [Lyrics Count]. The number of characters of [Lyrics Speed] is scrolled at a speed of the musical note of [Scroll Speed] per each character.

The status of the map end is EOh, and the data is EOh.

Further, the status of the track end is FEh, and the data is FEh.

Further, data of two languages or a parody of a song, etc. can be stored into the areas of LF6 to LF13. It is to be noted that such data are not stored when they are not used.

The PCM file is a file PF in which data of sound effect or back chorus, etc. that cannot be generated by the MIDI sound source, and includes data areas of PF1 to PF6. As the method of storing data, various methods such as the PCM (Pulse Code Modulation) method or the ADPCM (Adaptive Differential Pulse Code Modulation), etc. can be adopted.

The Table file IF is a file for retrieval, and includes IF1 and IF2. In the information file IF1, there are included the title of a musical composition, the name of a singer, the name of a lyric writer, the name of a musical composer, genre of a music, lyrics inserted, LVD screen setting data, etc. On the introduction sequence track IF2, sequence data for allowing the MIDI sound source to play one phrase of a music is stored. An example of the detailed configuration of the Table file IF is shown in FIG. 14.

Further, the example where an image of these retrieval data is displayed as Table is shown in FIG. 15.

FIG. 16 shows an example of an image displayed in the case of the displaying the reservation state by making use of this Table data.

Figure 2A:
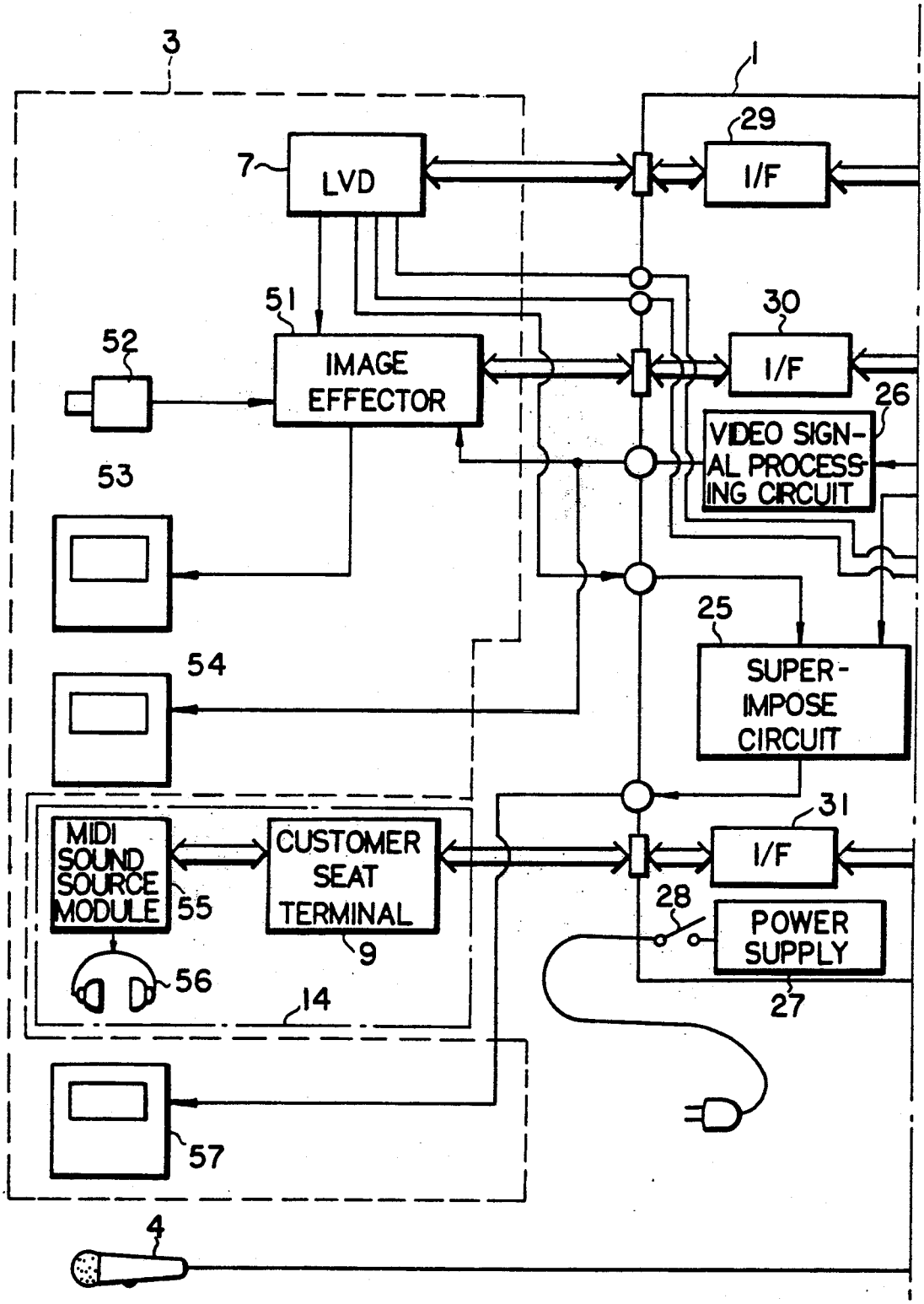
FIGS. 2A–C are views showing the configuration of a MIDI musical accompaniment playing apparatus which is an embodiment of the present invention.
Figure 2B:
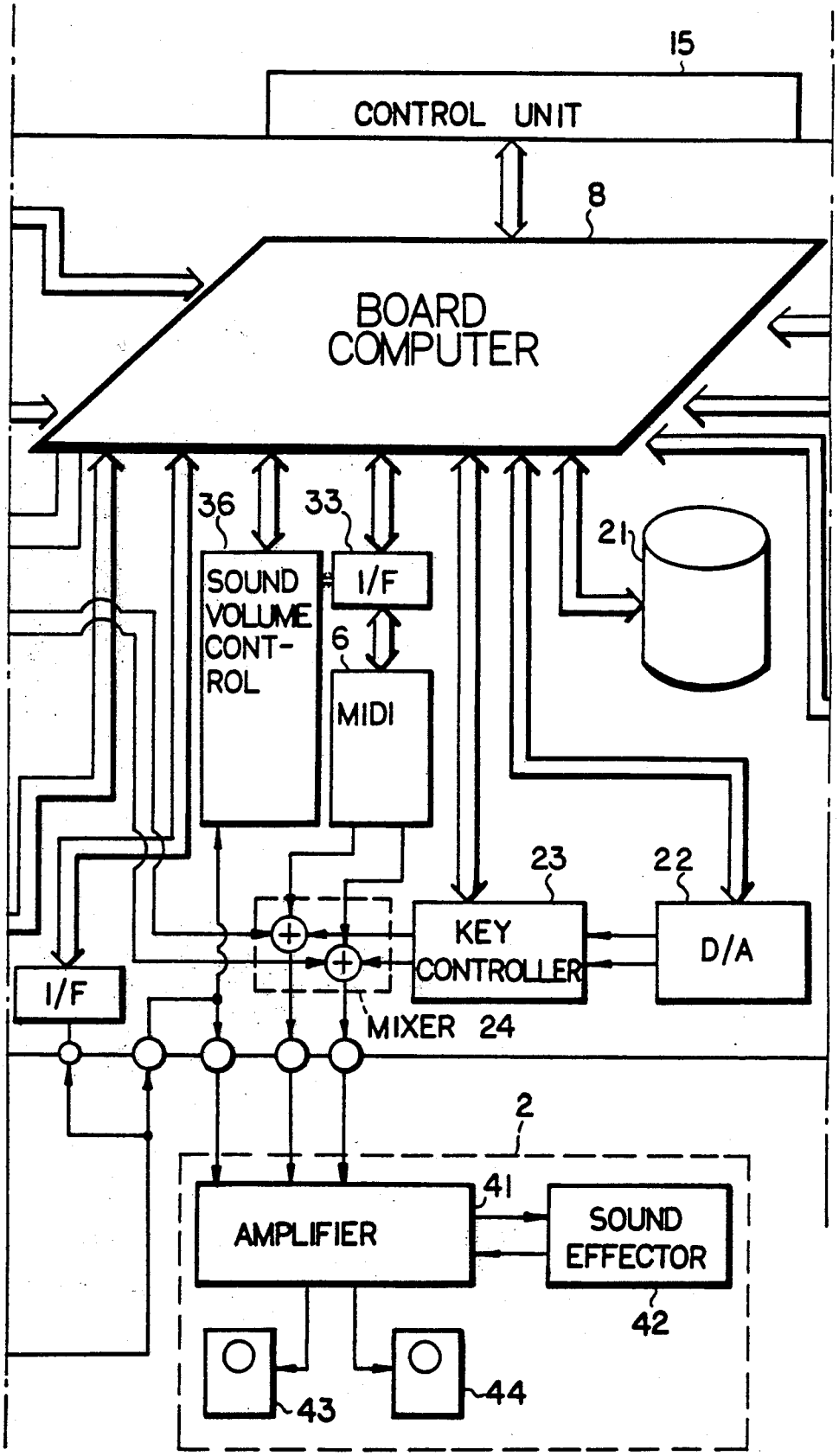
Figure 2C:
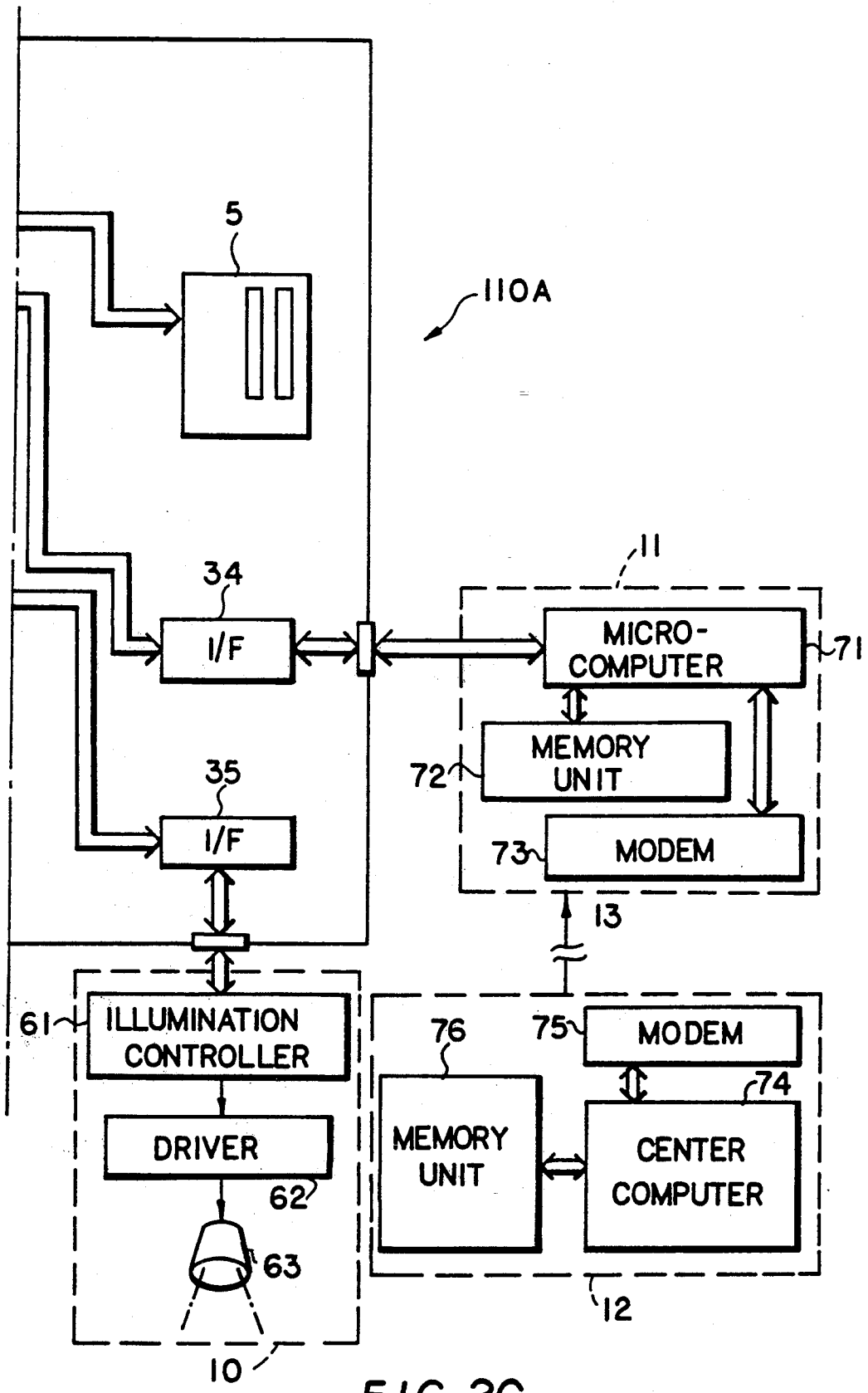

An embodiment in which there is disclosed a musical accompaniment playing apparatus according to the present invention will now be described with reference to FIG. 2 to 5. This MIDI musical accompaniment playing apparatus 110A roughly comprises, as shown in FIG. 2, a MIDI control unit 1, a sound output system 2, an image display system 3, a microphone 4 serving as the acoustoelectric conversion means, an illumination system 10, and a Table system 14. As the additional system, there are a data receiving system 11, and a data transmitting system 12 connected to the data receiving system 11 through a telephone line 13.

More particularly, the MIDI control unit 1 comprises an OMDD (Optical Memory Disk Drive) 5 serving as the musical accompaniment playing information reproducing means for writing or reproducing information by using an OMD (not shown) serving as the musical accompaniment playing information memory medium, a MIDI sound source module 6 serving as the MIDI sound source means, a board computer 8 serving as the control means, an operation unit 15, a memory unit 21 such as a hard disk, etc. for storing the control program, etc. of the board computer 8, a D/A converter 22, a key controller 23, a mixer 24, a superimpose circuit 25, a video signal processing circuit 26, a power supply 27, a power switch 28, interfaces 29, 30, 31, 32, 33, 34 and 35, and a sound volume control block 36.

Further, the sound output system 2 comprises an amplifier 41, a sound effector 42, and speakers 43 and 44. Here, the sound output system 2 constitutes the sound output means. In addition, the mixer 24 constitutes the mixing means.

The image display system 3 comprises a LVD player 7, an image effector 51, a video camera 52, a customer display 53, a display 54 for reservation, and a display 57 for a singer. Here, the image display system 3 constitutes the image display means.

The Table system 14 includes a customer's seat terminal 9 for customers, a MIDI sound source module 55, and a head phone 56.

The illumination system 10 comprises an illumination controller 61, a driver 62 and an illumination unit 63.

The data receiving system 11 comprises a microcomputer 71, a memory unit 72 and a modem 73.

The data transmitting system 12 comprises a center computer 74, a modem 75 and a memory unit 76.

Figure 3:
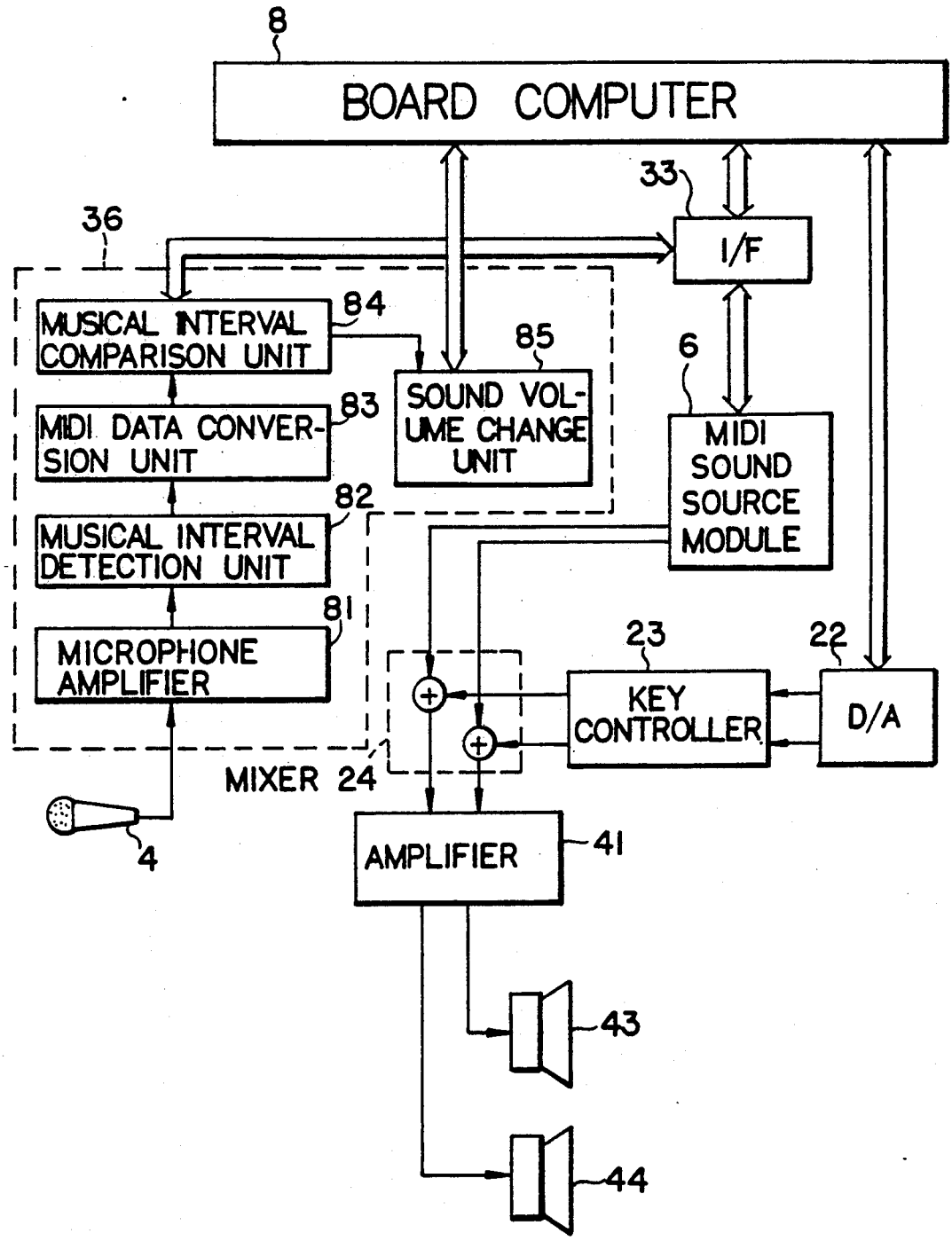
FIG. 3 is a view showing the configuration of the sound volume control block in FIG. 2.

The detailed configuration of the sound volume control block 36 is shown in FIG. 3. The sound volume control block 36 comprises a microphone amplifier 81, a musical interval detection unit 82, a MIDI data conversion unit 83, a musical interval comparison unit 84, and a sound volume change unit 85.

Figure 4:
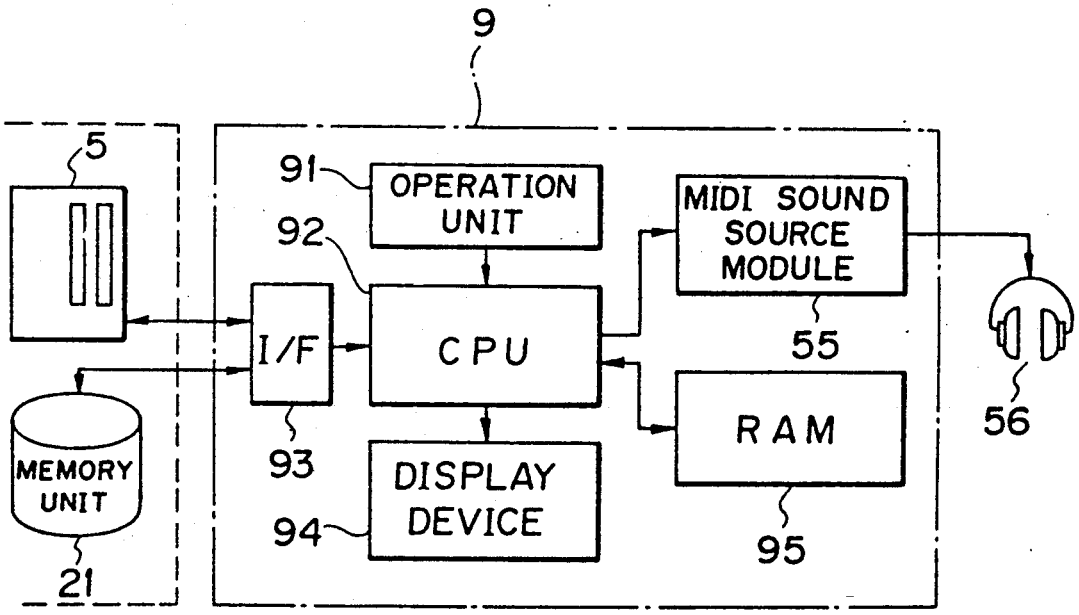
FIG. 4 is a view showing the configuration customer's seat terminal in FIG. 2, FIGS. 5(*a*)–5(*c*) are views for explaining the operation of the sound volume control block of FIG. 3, FIGS. 6 and 7 are views showing a conventional musical accompaniment playing apparatus.

The configuration of the customer terminal 9 will now be described with reference to FIG. 4. The customer terminal 9 comprises, as shown, an operation unit 91, a CPU 92, an interface 93, a display device 94, and a RAM 95.

The operation at time of playing of the MIDI musical accompaniment playing apparatus 110A will now be described.

The Table file IF of the MIDI musical accompaniment playing data is transmitted to a RAM (not shown) in the board computer 8 when the system is powered. The Table file IF is retrieved by operating the control unit 15 to request a song that a singer desires to sing. The board computer 8 responds to the request to read, from the OMDD 5, data (note file NF, lyrics file LF, PCM file PF) of a corresponding music in the sequential file, thus to store it into the RAM in the board computer 8. As the music data, there are a note file NF (including image select data) transmitted to the MIDI sound source module 6, a lyrics file LF transmitted to the superimpose circuit 25, and a PCM file PF transmitted to the D/A converter 22.

Then, a command is transmitted to the LVD player 7 to allow it to search the background image designated as data in the Table file IF, thus causing the LVD player 7 to play a music. At the same time that image appears, musical performance begins. The board computer 8 reads out, from the RAM, note file data NF to transform it to a MIDI signal to transmit that signal to the MIDI sound source module 6, and to transmit it to the sound volume control block 36. Then, a voice signal from the MIDI sound source module 6 is transmitted to the mixer 24. In synchronism with this, PCM file data PF is read out. The data thus read out is transmitted to the D/A converter 22. The D/A converter 22 converts that data to an analog voice signal to transmit it to the mixer 24, at which two signals are mixed. The mixed signal thus obtained is delivered to the amplifier 41. Thus, sound is produced from the speakers 43 and 44. At the amplifier 41, a voice signal from the microphone 4 is mixed with the above mentioned signal to produce sound from speakers 43 and 44. The board computer 8 reads out lyrics file data LF in synchronism with output of the MIDI signal and the PCM signal relating to voice to convert it to a character signal to deliver that character signal to the superimpose circuit 25. The superimpose circuit 25 superimposes the character signal and a video signal sent from the LVD player 7 to send it to the display 57 for singer. A singer sings a song with a microphone 4 in his or her hand while looking at the display 57 and the lyrics thereon. Further, an approach may be employed to generate a key control signal from a signal generator (not shown) provided in the microphone 4 so as to become in correspondence with the pitch of a singer to send the MIDI signal and the PCM signal of which keys are changed in correspondence with change of the key at the control unit board computer 8, thereby making it possible to change the key of sound. The voice of a singer from the microphone is sent to the sound volume control block 36, and is compared with a MIDI signal of accompaniment. Depending upon the result, sound volume data sent to the MIDI sound source module 6 is controlled.

The operation of the sound volume control block will now be described with reference to FIGS. 3 and 5.

In FIG. 3, a voice of a singer taken in from the microphone 4 is suitably amplified by the microphone amplifier 81, and is then sent to the musical interval detection unit 82. The musical interval detection unit 82 includes a fundamental period extraction device (see Japanese Patent Application No. 43200/90), and extracts that fundamental period from the signal to send it to the MIDI data conversion unit 83. The MIDI data conversion unit 83 converts the fundamental period data to MIDI data to send it to the musical interval comparison unit 84. To the musical interval comparison unit 84, a MIDI signal of the musical accompaniment playing is also sent through the interface 33 from the board computer 8. The musical interval comparison unit 84 compares note numbers of the two MIDI data. At this time, with respect to the MIDI signal of the musical accompaniment playing, data within a predetermined time range is given as reference by taking shift of the timing due to the way of singing into consideration. The compared result is sent to the sound volume change unit 85. When the difference therebetween is above a fixed value and a fixed time interval, the sound volume change unit 85 sends a signal to the board computer 8 to increase the sound volume (velocity value) of the MIDI musical accompaniment playing signal to send it to the MIDI sound source module 6. The MIDI sound source module generates a musical accompaniment playing signal on the basis of the altered sound volume data (velocity value) to send it to the mixer 24. To the mixer 24, a musical signal from the PCM signal is also sent from the board computer 8 through the D/A converter 22 and the key controller 23. Thus, both signals are mixed and are outputted as sound via the amplifier 41, and the speakers 43 and 44.

The above-mentioned operation will now be described with reference to FIGS. 5(A)–5(C). Namely, the MIDI data shown in FIG. 8 is indicated as in FIG. 5(A) for brevity of explanation. When, as shown in FIG. 5(B), MIDI data of a voice from the microphone 4 is assumed as M1, and data of the MIDI signal for musical accompaniment playing from the board computer 8 is assumed as M2, the difference between note number values indicating the musical interval is equal to 10. Further, at this time, comparison with data before and after M2 is made according to need. In the case of FIG. 5(B), it is indicated that, assuming that the value of a predetermined difference where the sound volume should be altered is, e.g., 5, the velocity value according to the sound volume of the next MIDI signal M3 for musical accompaniment playing, which follows the MIDI signal M2, is increased from 30, as shown as M3, to 70, as shown a M4, by the board computer 8 according to the compared result at the musical interval comparison unit 84 to output it to the MIDI sound source module 6, as shown in FIG. 5(C).

As stated above, by the sound volume control block 36, melody is caused to be easy to hear when the shift quantity of the musical interval is large in dependency upon the difference between the musical interval of a voice sung and that of musical accompaniment. Thus, a singer becomes easy to sing a song, and a listener becomes easy to hear that song. In contrast, when the difference between their intervals is small, the sound volume of melody is caused to be in correspondence with a standard sound volume for a second time. In addition, since the sound volume control block 36 does not change any other components except for the melody line, there results less disagreement of feeling.

The operation relating to the data communication of the musical accompaniment playing apparatus 110A will now be described.

In the existing musical accompaniment playing apparatuses in the form of LVD and CD, delivery of new musics is carried out by delivering disks. However, in the MIDI musical accompaniment playing system, since the music is not in the form of disk, but in the form of data, it is possible to deliver it by making use of the data communication. The configuration therefor is roughly classified into data receiving system 11 and data transmitting system 12 on the delivery side, which are added to the MIDI musical accompaniment playing apparatus 110A serving as the basic system.

The communication is carried out in accordance with a predetermined protocol. In the data communication system 12, the center computer 74 carries out supervisory control of the entirety thereof. This center computer 74 read thereinto MIDI musical accompaniment playing data stored in the memory unit 76 to send it to the data receiving system 11 in accordance with the above mentioned communication protocol through the modem 75. On the other hand, on the data receiving system 11 side, the microcomputer 71 carries out supervisory control of the entirety thereof to receive data through the modem 73 in accordance with the above mentioned communication protocol to temporarily store it into the memory unit 72. When all data have been transferred, communication is completed in accordance with the protocol. When the board computer 8 is not busy, data temporarily stored into the memory unit 72 is transferred to the OMDD 5 through the microcomputer 71 and the board computer 8, and is stored thereat. In this way, delivery of new musics is carried out.

The board computer 8 controls the illumination system 10 on the basis of illumination control data in the note file NF, thus making it possible to provide atmosphere in harmony with the feeling of the music during playing of the musical accompaniment.

Further, in the case where a plurality of lyrics data are included in the lyrics file LF (for example, in the case of lyrics of two languages or more), one lyric (for example, lyric of the Japanese) is ordinarily displayed. If a singer selects another lyric by making use of the operation unit 15 depending upon his or her preference, alternation of musics is ready to be made at any time from that time point. For example, an alternation from the Japanese to the English, and to the Japanese for a second time may be carried out, or lyrics of the Japanese and the English may be displayed at the same time. In the lyrics data, data of display color and/or display timing, etc. are also included.

Namely, in the case of a song where a plurality of lyrics are present with respect to one music, a singer can freely select a desired lyric. Further, musical accompaniment playing data for the foreign language and that for the Japanese may be commonly used. In addition, performance corresponding to the preference of a singer such as duet together with a foreigner or singing a part to be sung in a chastened or practiced voice in English may be conducted. In addition, not only lyrics of two languages but also a parody of song may be similarly displayed.

The operation relating to the Table system 14 will now be described with reference to FIG. 4.

The Table file IF is stored into RAM 95 by the OMDD5 of the MIDI control unit 1 when the system is powered. Since the Table file IF exists per each music, Table files corresponding to the number of songs stored in the OMDD 5 within the MIDI control unit 1 are stored into the RAM 95.

Thus, retrieval of musics can be conducted in dependency upon the title of a musical composition, the name of a singer, the name of a lyric writer, the name of a musical composer, and genre, etc.. Further, by transmitting sequence data of a retrieved music to the MIDI sound source module 55, a user can hear the introduction part (or a portion in the middle of a music).

Further, in the case where reservation of a music is given, reservation data is temporarily stored into the memory unit 21 in the MIDI control unit 1. Then, data of the name of a musical composition, the name of a singer and the order of reservation, or a person who makes reservation are read out in addition to data of the number of the music, and are changed to character data. Those character data are displayed on a disply. Thus, a user can understand at a glance the order of playing of a song that the user has reserved, or whether or not a song that the user wants to sing is already reserved, etc., which could not be grasped by conventional musical accompaniment players.

While explanation has been given in the above described embodiment in connection with the example where writable OMD is used as the musical accompaniment playing information recording medium, such a medium is not necessarily required to be writable, if new musics are delivered not only in the form of data, but also in the form of memory media. For example, ordinary CDs, CD ROMs, semiconductor memories, IC cards, magnetic memories, or photomagnetic disks, etc. may be used for this purpose.

In addition, while, in the above described embodiment, explanation has been given in connection with the example where when the difference between the musical interval of a voice from the microphone and that of the MIDI signal for musical accompaniment playing is large, sound volume of the MIDI signal for musical accompaniment playing is caused to be increase, a technique may be jointly employed in which an attenuator, etc. is used to attenuate the level of a voice from the microphone.

As described above, in accordance with the present invention, even if there occurs any change in the musical interval of a singer, it is possible to carry out a musical accompaniment playing such that a singer is easy to sing, and a listener is easy to hear.

What is claimed is:

1. A musical accompaniment playing apparatus comprising:

musical accompaniment information reproducing means for reproducing MIDI sound source control information from a musical accompaniment information recording medium on which the MIDI sound source control information for controlling MIDI sound source means to generate musical accompaniment information in conformity with a MIDI standard is recorded;

said MIDI sound source means for generating the musical accompaniment information by the MIDI sound source control information reproduced by said musical accompaniment information reproducing means;

an acoustoelectric transducer for transforming a voice sung by a singer to an electric signal to output it as voice information;

sound interval comparing means for comparing a sound interval of the voice information with a sound interval of the musical accompaniment information to output a comparison result signal;

sound volume control means for controlling a sound volume level of the musical accompaniment information in accordance with said comparison result signal;

mixing means for mixing the musical accompaniment information and the voice information to output it as mixed sound information, and sound output means for transforming the mixed sound information to sound to output it.

2. A musical accompaniment playing apparatus as set forth in claim 1, wherein said singing ability includes an ability to keep a musical key of a voice sung by the singer in tune with a musical accompaniment outputted by said sound output means or an ability to keep a singing timing of a voice sung by the singer in time with a musical accompaniment outputted by said sound output means.

3. A musical accompaniment playing apparatus as set forth in claim 1, wherein said sound interval comparing means outputs the comparison result signal when a difference between said sound interval of the voice information and said sound interval of the musical accompaniment information exceeds a predetermined difference value.

4. A musical accompaniment playing apparatus as set forth in claim 1, wherein said sound volume control means increases the volume level of the musical accompaniment information in response to the comparison result signal.

5. A musical accompaniment playing apparatus as set forth in claim 4, wherein the increased value of the sound volume corresponds to a difference between said sound interval of the voice information and said sound interval of the musical accompaniment information.

6. A musical accompaniment playing apparatus set forth in claim 1, wherein said sound interval comparing means compares the sound intervals of the voice information and the musical accompaniment information and outputs the comparison result signal at every predetermined time period.

7. A musical accompaniment playing apparatus comprising:

musical accompaniment information reproducing means for reproducing MIDI sound source control information from a musical accompaniment information recording medium on which the MIDI sound source control information for controlling MIDI sound source means to generate musical accompaniment information in conformity with a MIDI standard is recorded;

said MIDI sound source means for generating the musical accompaniment information by the MIDI sound source control information reproduced by said musical accompaniment information reproducing means;

an acoustoelectric transducer for transforming a voice sung by a singer to an electric signal to output it as voice information;

sound interval comparing means for comparing a sound interval of the voice information with a sound interval of the musical accompaniment information to output a comparison result signal;

sound volume control means for controlling a sound volume level of the voice information in accordance with said comparison result signal;

mixing means for mixing the musical accompaniment information and the voice information to output it as mixed sound information, and sound output means for transforming the mixed sound information to sound to output it.

8. A musical accompaniment playing apparatus as set forth in claim 7, wherein said singing ability includes an ability to keep a musical key of a voice sung by the singer in tune with a musical accompaniment outputted by said sound output means or an ability to keep a singing timing of a voice sung by the singer in time with a musical accompaniment outputted by said sound output means.

9. A musical accompaniment playing apparatus as set forth in claim 7, wherein said sound interval comparing means outputs the comparison result signal when a difference between said sound interval of the voice information and said sound interval of the musical accompaniment information exceeds a predetermined difference value.

10. A musical accompaniment playing apparatus as set forth in claim 7, wherein said sound volume control means decreases the volume level of the voice information in response to the comparison result signal.

11. A musical accompaniment playing apparatus as set forth in claim 10, wherein the decreased value of the sound volume corresponds to a difference between said sound interval of the voice information and said sound interval of the musical accompaniment information.

12. A musical accompaniment playing apparatus set forth in claim 7, wherein said sound interval comparing means compares the sound intervals of the voice information and the musical accompaniment information and outputs the comparison result signal at every predetermined time period.

13. A musical accompaniment apparatus comprising:

musical accompaniment information reproducing means for reproducing MIDI sound source control information and second musical information from a musical accompaniment information recording medium on which the MIDI sound source control information for controlling MIDI sound source means to generate first musical information in conformity with a MIDI standard and the second musical information to be mixed with the first musical information to form musical accompaniment information are recorded;

said MIDI sound source means for generating the first musical information by MIDI sound source control information reproduced by said musical accompaniment information reproducing means;

an acoustoelectric transducer for transforming a voice sung by a singer to an electric signal to output it as voice information;

sound interval comparing means for comparing a sound interval of the voice information with a sound interval of the musical accompaniment information to output a comparison result signal;

sound volume control means for controlling a sound volume level of the musical accompaniment information in accordance with said comparison result signal;

mixing means for mixing the generated first musical information, the reproduced second musical information and the voice information to output it as mixed sound information; and sound output means for transforming the mixed sound information to sound to output it.

14. A musical accompaniment playing apparatus as set forth in claim 13, wherein said singing ability includes an ability to keep a musical key of a voice sung by the singer in tune with a musical accompaniment outputted by said sound output means or an ability to keep a singing timing of a voice sung by the singer in time with a musical accompaniment outputted by said sound output means.

15. A musical accompaniment playing apparatus as set forth in claim 13, wherein said sound interval comparing means outputs the comparison result signal when a difference between said sound interval of the voice information and said sound interval of the musical accompaniment information exceeds a predetermined difference value.

16. A musical accompaniment playing apparatus as set forth in claim 13, wherein said volume control means increases the volume level of the musical accompaniment information in response to the comparison result signal.

17. A musical accompaniment playing apparatus as set forth in claim 16, wherein the increased value of the sound volume corresponds to a difference between said sound interval of the voice information and said sound interval of the musical accompaniment information.

18. A musical accompaniment playing apparatus set forth in claim 13, wherein said sound interval comparing means compares the sound intervals of the voice information and the musical accompaniment information and outputs the comparison result signal at every predetermined time period.

19. A musical accompaniment apparatus comprising:

musical accompaniment information reproducing means for reproducing MIDI sound source control information and second musical information from a musical accompaniment information recording medium on which the MIDI sound source control information for controlling MIDI sound source means to generate first musical information in conformity with a MIDI standard and the second musical information to be mixed with the first musical information to form musical accompaniment information are recorded;

said MIDI sound source means for generating the first musical information by MIDI sound source control information reproduced by said musical accompaniment information reproducing means;

an acoustoelectric transducer for transforming a voice sung by a singer to an electric signal to output it as voice information;

sound interval comparing means for comparing a sound interval of the voice information with a sound interval of the musical accompaniment information to output a comparison result signal;

sound volume control means for controlling a sound volume level of the voice information in accordance with said comparison result signal;

mixing means for mixing the generated first musical information, the reproduced second musical information and the voice information to output it as mixed sound information; and sound output means for transforming the mixed sound information to sound to output it.

20. A musical accompaniment playing apparatus as set forth in claim 19.

wherein said singing ability includes an ability to keep a musical key of a voice sung by the singer in tune with a musical accompaniment outputted by said sound output means or an ability to keep a singing timing of a voice sung by the singer in time with a musical accompaniment outputted by said sound output means.

21. A musical accompaniment playing apparatus as set forth in claim 19, wherein said sound interval comparing means outputs the comparison result signal when a difference between said sound interval of the voice information and said sound interval of the musical accompaniment information exceeds a predetermined difference value.

22. A musical accompaniment playing apparatus as set forth in claim 19, wherein said sound volume control means decreases the volume level of the voice information in response to the comparison result signal.

23. A musical accompaniment playing apparatus as set forth in claim 22, wherein the decreased value of the sound volume corresponds to a difference between said sound interval of the voice information and said sound interval of the musical accompaniment information.

24. A musical accompaniment playing apparatus set forth in claim 19, wherein said sound interval comparing means compares the sound intervals of the voice information and the musical accompaniment information and outputs the comparison result at every predetermined time period.

25. A musical accompaniment playing apparatus comprising:

musical accompaniment information reproducing means for reproducing MIDI sound source control information from a musical accompaniment information recording medium on which the MIDI sound source control information for controlling MIDI sound source means to generate musical accompaniment information in conformity with a MIDI standard is recorded, said musical accompaniment information having a plurality of first note information, and said MIDI sound source control information having first MIDI note information for tuning a musical interval of each first note information;

said MIDI sound source means for generating the musical accompaniment information by the MIDI sound source control information reproduced by said musical accompaniment information reproducing means;

an acoustoelectric transducer for transforming a voice sung by a singer to an electric signal to output it as voice information having a plurality of second note information;

musical interval detection means for detecting a musical interval of the second note information to transform said detected musical interval to information according to the MIDI standard to output it as second MIDI note information;

comparison means for comparing the first MIDI note information with the second MIDI note information and outputting a result signal, said result signal having a result value according to a difference between the first MIDI note information and the second MIDI note information;

control means for controlling a sound volume level of the musical accompaniment information in accordance with the outputted result signal;

mixing means for mixing the musical accompaniment information and the voice information to output it as mixed sound information; and sound output means for transforming the mixed sound information to sound to output it.

26. A musical accompaniment playing apparatus as set forth in claim 25, wherein said comparison means outputs the result signal when a difference between said sound interval of the first MIDI note information and said sound interval of the second MIDI note information exceeds a predetermined difference value.

27. A musical accompaniment playing apparatus as set forth in claim 26, wherein said control means increases the volume level of the musical accompaniment information in response to the result signal.

28. A musical accompaniment playing apparatus as set forth in claim 27, wherein said increased value of the sound volume corresponds to a difference between said sound interval of the first MIDI note information and said sound interval of the second MIDI note information.

29. A musical accompaniment playing apparatus set forth in claim 25, wherein said comparison means compares the sound intervals of the first MIDI note information and the second MIDI note information and outputs the result signal at every predetermined time period.

30. A musical accompaniment playing apparatus comprising:

musical accompaniment information reproducing means for reproducing MIDI sound source control information from a musical accompaniment information recording medium on which the MIDI sound source control information for controlling MIDI sound source means to generate musical accompaniment information in conformity with a MIDI standard is recorded, said musical accompaniment information having a plurality of first note information, and said MIDI sound source control information having first MIDI note information for tuning a musical interval of each first note information;

said MIDI sound source means for generating the musical accompaniment information by the MIDI sound source control information reproduced by said musical accompaniment information reproducing means;

an acoustoelectric transducer for transforming a voice sung by a singer to an electric signal to output it as voice information having a plurality of second note information;

musical interval detection means for detecting a musical interval of the second note information to transform said detected musical interval to information according to the MIDI standard to output it as second MIDI note information;

comparison means for comparing the first MIDI note information with the second MIDI note information and outputting a result signal, said result signal having a result value according to a difference between the first MIDI note information and the second MIDI note information;

control means for controlling a sound volume level of the voice information in accordance with the outputted result signal;

mixing means for mixing the musical accompaniment information and the voice information to output it as mixed sound information; and sound output means for transforming the mixed sound information to sound to output it.

31. A musical accompaniment playing apparatus as set forth in claim 30, wherein said comparison means outputs the result signal when a difference between said sound interval of the first MIDI note information and said sound interval of the second MIDI note information exceeds a predetermined difference value.

32. A musical accompaniment playing apparatus as set forth in claim 30, wherein said control means decreases the volume level of the voice information in response to the result signal.

33. A musical accompaniment playing apparatus as set forth in claim 32, wherein said decreased value of the sound volume corresponds to a difference between said sound interval of the first MIDI note information and said sound interval of the second MIDI note information.

34. A musical accompaniment playing apparatus set forth in claim 30, wherein said comparison means compares the sound intervals of the first MIDI note information and the second MIDI note information and outputs the result signal at every predetermined time period.

35. A musical accompaniment playing apparatus comprising:

musical accompaniment information reproducing means for reproducing MIDI sound source control information from a musical accompaniment information recording medium on which the MIDI sound source control information for controlling MIDI sound source means to generate musical accompaniment information in conformity with a MIDI standard is recorded, said musical accompaniment information having a plurality of first note information, and said MIDI sound source control information having first MIDI note information for tuning a musical interval of each first note information;

said MIDI sound source means for generating the musical accompaniment information by the MIDI sound source control information reproduced by said musical accompaniment information reproducing means;

an acoustoelectric transducer for transforming a voice sung by a singer to an electric signal to output it as voice information having a plurality of second note information;

musical interval detection means for detecting a musical interval of the second note information to transform said detected musical interval to information according to the MIDI standard to output it as second MIDI note information;

comparison means for comparing the first MIDI note information with the second MIDI note information and outputting a result signal, said result signal having a result value according to a difference between the first MIDI note information and the second MIDI note information;

control means for controlling MIDI velocity information of the musical accompaniment information in accordance with the result signal, said MIDI velocity information indicating sound volume level of the musical accompaniment information;

mixing means for mixing the musical accompaniment information and the voice information to output it as mixed sound information; and sound output means for transforming the mixed sound information to sound to output it.

36. A musical accompaniment playing apparatus as set forth in claim 35, wherein said comparison means outputs the result signal when a difference between said sound interval of the first MIDI note information and said sound interval of the sound MIDI note information exceeds a predetermined difference value.

37. A musical accompaniment playing apparatus as set forth in claim 35, wherein said control means increases the volume of the MIDI velocity information of the musical accompaniment information in response to the result signal.

38. A musical accompaniment playing apparatus as set forth in claim 37, wherein the increased value of the MIDI velocity information corresponds to a difference between said sound interval of the first MIDI note information and said sound interval of the second MIDI note information.

39. A musical accompaniment playing apparatus set forth in claim 36, wherein said comparison means compares the sound intervals of the first MIDI note information and the second MIDI note information and outputs the result signal at every predetermined time period.

40. A musical accompaniment playing apparatus comprising:

musical accompaniment information reproducing means for reproducing MIDI sound source control information from a musical accompaniment information recording medium on which the MIDI sound source control information for controlling MIDI sound source means to generate musical accompaniment information in conformity with a MIDI standard is recorded, said musical accompaniment information having a plurality of first note information, and said MIDI sound source control information having first MIDI note information for tuning a musical interval of each first note information;

said MIDI sound source means for generating the musical accompaniment information by the MIDI sound source control information reproduced by said musical accompaniment information reproducing mean;

an acoustoelectric transducer for transforming a voice sung by a singer to an electric signal to output it as voice information having a plurality of second note information;

musical interval detection means of detecting a musical interval of the second note information to transform said detected musical interval to information according to the MIDI standard to output it as second MIDI note information;

comparison means for comparing the first MIDI note information with the second MIDI note information and outputting a result signal, said result signal having a result value according to a difference between the first MIDI note information and the second MIDI note information;

control means for controlling MIDI velocity information of the voice information in accordance with the result signal, said MIDI velocity information indicating sound volume level of the voice information;

mixing means for mixing the musical accompaniment information and the voice information to output it as mixed sound information; and sound output means for transforming the mixed sound information to sound to output it.

41. A musical accompaniment playing apparatus as set forth in claim 40, wherein said comparison means outputs the result signal when a difference between said sound interval of the first MIDI note information and said sound interval of the second MIDI note information exceeds a predetermined difference value.

42. A musical accompaniment playing apparatus as set forth in claim 40, wherein said control means decreases the volume of the MIDI velocity information of the voice information in response to the result signal.

43. A musical accompaniment playing apparatus as set forth in claim 42, wherein the decreased value of the MIDI velocity information corresponds to a difference between said sound interval of the first MIDI note information and said sound interval of the second MIDI note information.

44. A musical accompaniment playing apparatus set forth in claim 40, wherein said comparison means compares the sound intervals of the first MIDI note information and the second MIDI note information and outputs the result signal at every predetermined time period.

* * * * *